United States Patent [19]

Rosenberg et al.

[11] Patent Number: 4,715,282

[45] Date of Patent: Dec. 29, 1987

[54] CLUSTER BOMB GRENADE WITH MEANS FOR SPIN RATE ATTENUATION

[75] Inventors: Avraham Rosenberg, Holon; Carol Ziner, Rishon Le-Zion, both of Israel

[73] Assignee: The State of Israel, Ministry of Defence, Israel Military Industries, Israel

[21] Appl. No.: 922,343

[22] Filed: Oct. 23, 1986

[30] Foreign Application Priority Data

Dec. 18, 1985 [IL] Israel ..... 77377

[51] Int. Cl.[4] ..... F42B 13/50; F42B 25/22

[52] U.S. Cl. ..... 102/227; 102/393; 244/3.29

[58] Field of Search ..... 102/226, 227, 225, 393, 102/385, 386, 387, 388, 348, 359, 489; 244/3.26–3.29

[56] References Cited

U.S. PATENT DOCUMENTS

| | | | |
|---|---|---|---|
| 3,633,846 | 1/1972 | Biggs | 244/3.27 |
| 3,712,217 | 1/1973 | Little et al. | 102/388 |
| 3,913,483 | 10/1975 | Wolterman | 102/227 X |
| 3,964,391 | 6/1976 | Zacharin | 102/388 |
| 3,968,748 | 7/1976 | Burford et al. | 102/396 X |
| 3,998,164 | 12/1976 | Hadfield | 102/226 |
| 4,162,053 | 7/1979 | Björnson | 102/348 X |
| 4,488,488 | 12/1984 | Looger et al. | 102/387 |
| 4,492,166 | 1/1985 | Purcell | 102/393 X |
| 4,565,341 | 1/1986 | Zacharin | 102/386 X |

FOREIGN PATENT DOCUMENTS

| | | | |
|---|---|---|---|
| 1199664 | 8/1965 | Fed. Rep. of Germany | 244/3.29 |
| 2635676 | 2/1978 | Fed. Rep. of Germany | 244/3.29 |

*Primary Examiner*—David H. Brown

*Attorney, Agent, or Firm*—Steinberg & Raskin

[57] ABSTRACT

A cluster bomb grenade having a fuse and striker pin mechanism in the rear portion is known per se. On the rear portion there are mounted telescoping wings in a centro-symmetrical arrangement and adapted to swing from a folded to an unfolded position. There are provided retainer means cooperating with the striker pin in such a fashion that in the locking position of the striker pin the wings are located in the folded position, which retainer means are adapted to be jettisoned upon retraction of the striker pin. There are also provided stop means for arresting the wings in a desired position. When in operation the grenade is rejected from its cargo projectile the telescoping wings unfold and extend, whereby the spin rate of the grenade is gradually reduced.

6 Claims, 4 Drawing Figures

CLUSTER BOMB GRENADE WITH MEANS FOR SPIN RATE ATTENUATION

FIELD OF THE INVENTION

The present invention concerns so-called cluster bombs, i.e. bombs comprising a plurality of explosive devices referred to as bomblets or grenades, packed into a cargo projectile. The cargo projectile can be launched from a ground based or airborne launching system. After launching the cargo projectile releases the individual grenades which then continue each in their flight towards the target where they arrive with a statistical spread. The grenades have, as a rule, shaped charges and they are effective against armour and personnel.

BACKGROUND OF THE INVENTION AND PRIOR ART

Cluster bombs are launched with a spin and consequently a spin is also imparted to the individual grenades. However, the spin gives rise to problems in that the grenades are likely to impact the target at a high yaw angle (the angle between the longitudinal axis of the grenade and the flight trajectory of the centre of gravity) which leads to a high percentage of duds and a considerable reduction in the effectiveness of the shaped charge.

In accordance with the prior art a grenade of a cluster bomb hits a target essentially with the same spin rate with which it is released from the cargo projectile and it is accordingly the object of the present invention to provide a cluster bomb grenade so designed that it reaches the target with a spin rate that is significantly reduced as compared to the spin rate at which the grenade is released from the cargo projectile.

A cluster bomb grenade of the kind specified comprises a striker pin designed to ignite the fuse when the grenade hits a target. In the unarmed state of the grenade the path of the striker pin is blocked and upon release of the grenade from the cargo projectile, the blockage is automatically removed whereupon the grenade is armed. The means for blocking the path of the striker pin may, for example, be in the form of a slidable member biased into a non-blocking position and locked in the blocking position by the striker pin itself. At its rear the striker pin comprises a drag tape which, upon release of the grenade unfolds and brings about retraction of the striker pin from engagement with said slidable member whereupon the latter moves automatically into a non-blocking position, clearing the path of the striker pin to the fuse. In this way the grenade is armed and when it hits a target the striker pin advances by force of inertia toward the fuse whereby the latter is ignited and the grenade is detonated.

GENERAL DESCRIPTION OF THE INVENTION

In accordance with the invention there is provided a grenade for packing into a cargo projectile together with a plurality of its kind to form a cluster bomb, comprising a body housing a detonable charge; a rear portion housing a fuse and a striker pin adapted to advance towards the fuse along a predetermined path when the grenade hits a target thereby to ignite the fuse, means for blocking the path of the striker pin towards the fuse when the grenade is in the unarmed state, which means are biased towards a non-blocking position and are locked in the blocking position by the striker pin; a drag tape connected to the rear of the striker pin which is folded in the unarmed state of the grenade and is unfolded upon release of the grenade from the cargo projectile whereby the striker pin is retracted from engagement with said blocking means and the latter move automatically into a non-blocking position whereupon the grenade is armed; characterized by:

(i) a plurality of telescoping wings swingably mounted on said rear portion in a centro-symmetrical arangement and adapted to swing from a folded to an unfolded position;

(ii) retainer means adapted for cooperation with said striker pin such that in the locking position of the striker pin the wings are locked in the folded position, which retainer means are adapted to be jettisoned upon retraction of the striker pin; and (iii) stop means for arresting the wings in a desired unfolded position.

When in operation a grenade according to the invention is released from the cargo projectile, the drag tape is unfolded and in consequence of the drag the striker pin is retracted from its locking position whereby said blocking means are unlocked and due to their bias move automatically into the non-blocking position thereby arming the grenade, all as known per se.

In consequence of the retraction of the striker pin as specified, the retainer means are unlocked and jettisoned whereby the wings are freed and swing into the unfolded position by the action of centrifugal forces resulting from the spin. Upon action of the same centrifugal forces the telescoping parts of the wings are extended whereby the wings are extended into a state of maximum spread. The extended wings offer an aerodynamic resistance in consequence of which the spin rate of the grenade is gradually reduced as the grenade proceeds towards the target, hitting the target at a significantly reduced spin rate whereby the drawbacks of the prior art grenades are largely overcome.

In accordance with one embodiment of the invention there are provided two telescoping wings. Other embodiments may comprise any other desired number of wings, e.g. three, four or more.

DESCRIPTION OF THE DRAWINGS

For better understanding of the invention reference will be had hereinafter to the annexed drawings in which.

DESCRIPTION OF A PREFERRED EMBODIMENT

Figure 3:
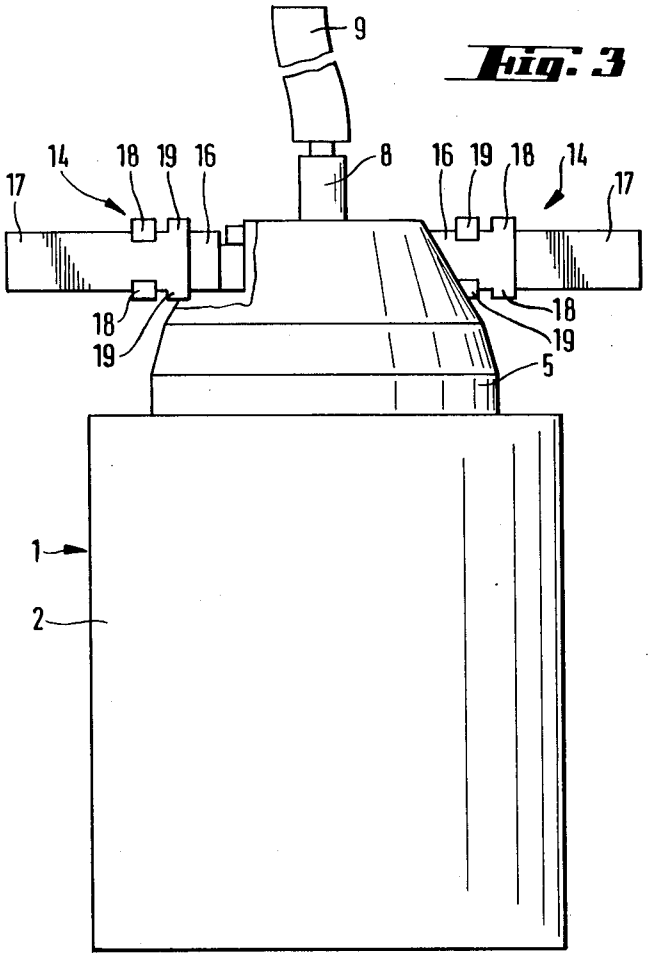
FIG. 3 is an elevation of the grenade according to FIG. 1 showing the drag tape and wings unfolded.

As shown in the Figures, a grenade 1 comprises a body 2 housing a detonable charge 2*a* and a rear portion 3 housing a fuse, schematically illustrated at 3*a* secured to the main body 2 by a plurality of rivets 4. Rear portion 3 comprises a boss 5 and a central block 6 with a transversal channel 7 extending in the interface region between them. Block 6 accommodates in a threaded engagement (not shown) a striker pin 8 which is shown in FIG. 1 in the locking position and which can be retracted by unscrewing into the unlocking position.

Figure 1:
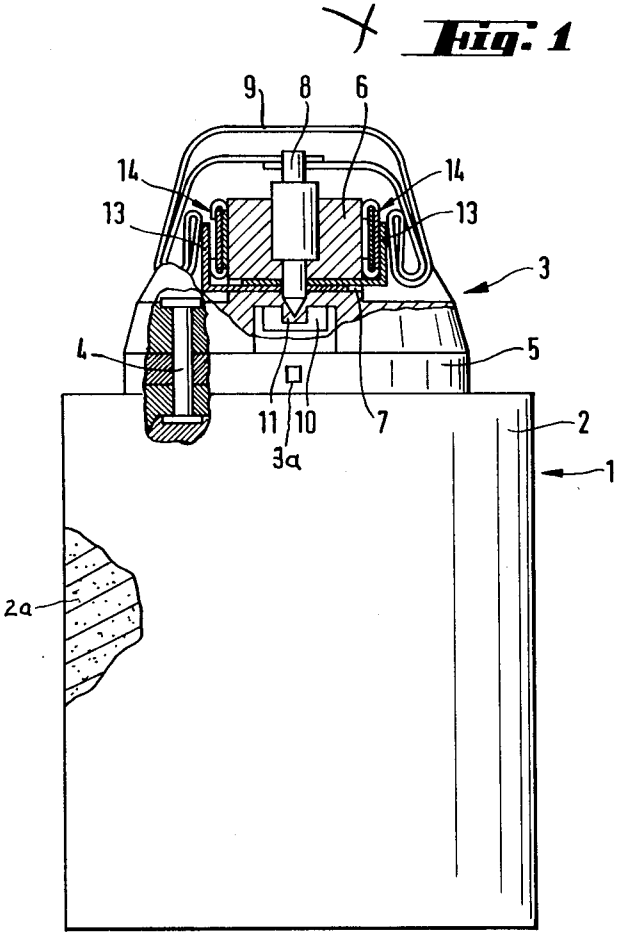
FIG. 1 is an elevation of a grenade according to the invention with the rear portion partly in section along line I—I of FIG. 2.

At its outer end striker pin 8 carries a drag tape 9 which in FIG. 1 is shown in the folded and in FIG. 3 in the unfolded state.

The boss 5 of rear portion 3 accommodates a slider 10 having on its upper surface a recess 11 which in the unarmed position shown in FIG. 1, is engaged by the pointed, inner end portion of striker pin 8.

The slider 10 is biased towards an extracted position but is retained in the retracted position shown in FIG. 1 as long as pin 8 engages recess 11.

Channel 7 accommodates one arm of each of a pair of L-shaped retainer members 13 which arm is bored and held in position by striker pin 8 in the manner shown in FIG. 1. When pin 8 is withdrawn, as will be explained further below, the retainer members 13 are no longer connected to the rear portion 3 and are jettisoned therefrom.

Figure 2:
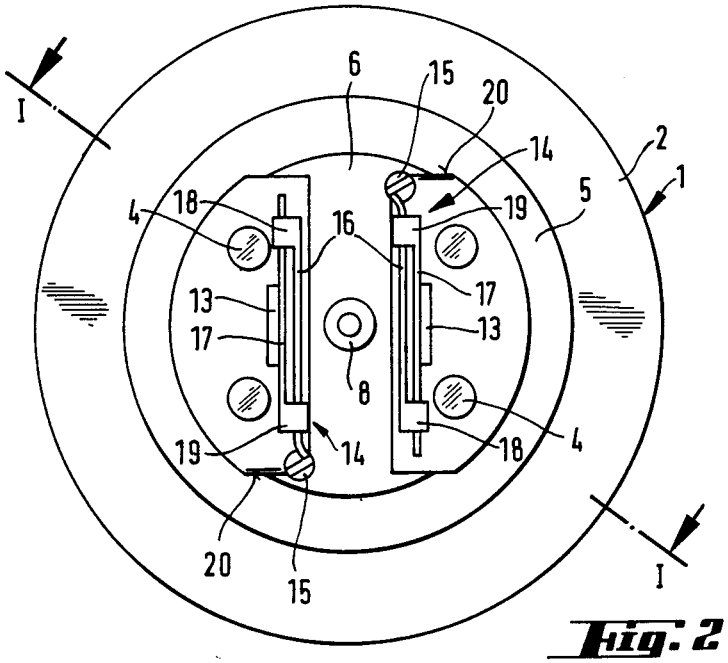
FIG. 2 is a plan view corresponding to FIG. 1 with the foldable drag tape removed.
Figure 4:
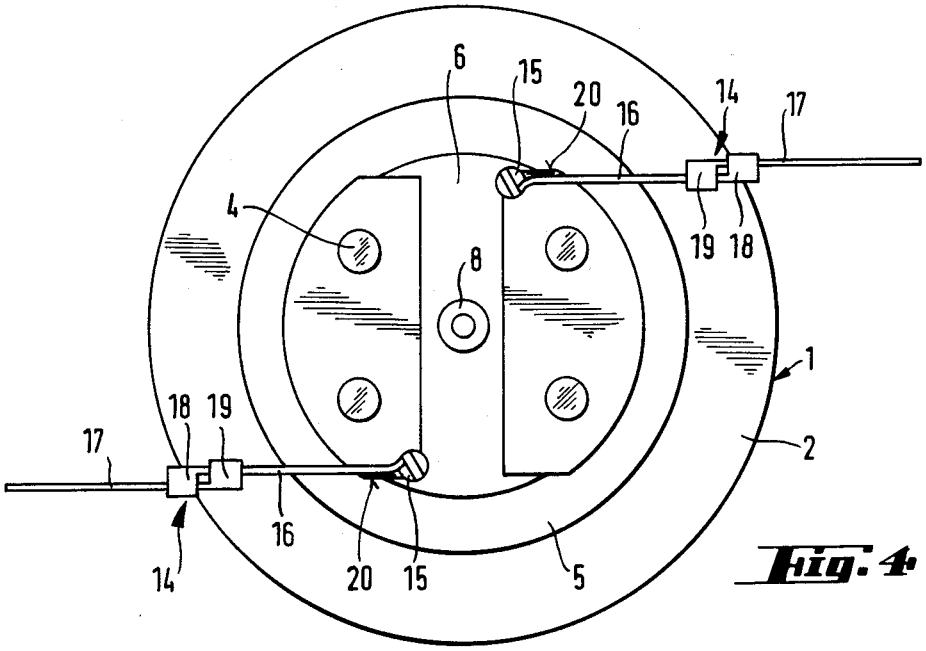
FIG. 4 is a plan view corresponding to FIG. 3 with the drag tape removed.

At the two opposite sides of boss 5 there are hinged a pair of telescoping wings 14 held in position by retainer members 13. Each of the wings 14 is hinged at 15 in such a way that once retainer members 13 are removed, wings 14 are unfolded by swinging about the hinges 15. Each of wings 14 comprises a first constituent part 16 and a second constituent part 17 slidably engaging each other. To this end each part 16 comprises grippers 18 loosely engaging part 17 and each part 17 comprises stops 19 adapted for cooperation with grippers 18 such that part 17 is arrested in the fully extended state as shown in FIG. 4. In the folded state of wings 14, parts 16 and 17 essentially overlap as shown in FIG. 2 while when the wings are unfolded the telescoping parts are extracted by the action of the centrifugal forces resulting from the spin, whereby wings 14 reach the fully unfolded and extended position shown in FIGS. 3 and 4.

Wall portions 20 integral with central block 6 serve as stops for wings 14 in their unfolded, extended position.

The above grenade function as follows:

A plurality of grenades of the kind shown in the Figures is packed into a cargo projectile which is launched with an axial spin as known per se. In consequence, when the grenades are released from the cargo projectile each individual grenade 1 proceeds in its own trajectory with an axial spin. Upon release of the grenade the drag tape 9 unfolds and by the combined action of the spin of the grenade and the drag of tape 9 there occurs a revolution of striker pin 9 inside block 6 whereby the pin is unscrewed and retracted from its engagement with slider 10 and retainer members 13.

The thus unlocked slider 10 now yields to its bias and moves out of the path of striker pin 8 into its armed position, as is known per se.

The unlocked retainer members 13 are jettisoned by the centrifugal forces resulting from the spin of the grenade and consequently wings 14 are now free to unfold and extend, again by action of the same centrifugal forces, to reach the fully unfolded and extended positions in which they are arrested by stops 20, as shown in FIGS. 3 and 4.

As the grenade proceeds in its flight with an axial spin the unfolded and extended wings 14 exert a braking effect whereby the spin rate is gradually reduced so that the grenade reaches its target with a significantly reduced spin and in this way the effectiveness of the grenade is significantly increased.

When the grenade hits the target, striker pin 8 moves by force of inertia towards the fuse inside rear portion 3 whereby the fuse is ignited and the explosive charge inside body 2 is detonated.

It will easily be understood on the basis of the above disclosure that a grenade according to the invention may comprise more than two telescoping wings mounted in a centro-symmetrical arrangement on the rear portion of the grenade and functioning in a manner essentially as described.

We claim:

1. In a grenade adapted to be packed into a cargo projectile together with a plurality of its kind to form a cluster bomb, comprising a body housing a detonable charge; a rear portion housing a fuse and a striker pin adapted to advance towards the fuse along a predetermined path when the grenade hits a target thereby to ignite the fuse, movable blocking means for blocking the path of the striker pin towards the fuse when the grenade is in the unarmed state, which movable blocking means are movable towards a non-blocking position and are locked in the blocking position through engagement by the striker pin when said striker pin is in a locking position; a drag tape connected to the rear of the striker pin which is folded in the unarmed state of the grenade and is unfolded upon release of the grenade from the cargo projectile whereby the striker pin is retracted from engagement with said moveable blocking means to an unlocking position and the latter move into a non-blocking position whereupon the grenade is armed; the improvement by which said grenade comprises:

(i) a plurality of telescoping wings swingably mounted on said rear portion in a centrosymmetrical arrangement and adapted to swing from a folded to an unfolded position;

(ii) retainer means releasably coupled to said striker pin for retaining said wings in the folded position when said striker pin is in said locking position with said retainer means coupled thereto and for releasing said wings for swinging movement to the unfolded position when said striker pin is retracted to said unlocking position with said retainer means uncoupled therefrom, which retainer means are adapted to be jettisoned upon retraction of the striker pin to said unlocking position; and (iii) stop means for arresting the wings in a desired unfolded position.

2. A grenade according to claim 1 having two telescoping wings.

3. A grenade according to claim 1 wherein said retainer means comprise substantially L-shaped members.

4. A grenade according to claim 1 wherein said retainer means include a member having a first portion through which a bore is formed, said striker pin extending through said bore when in its locking position, and a second portion situated adjacent to at least one of said wings in its folded position to retain said wing in said folded position.

5. A grenade according to claim 1 wherein said rear portion comprises a central block accommodating said striker pin, said telescoping wings being hinged on to said central block.

6. A grenade according to claim 2 wherein said stop means for arresting the wings in a desired, unfolded position are integral with said central block.

* * * * *